United States Patent [19]

Muth

[11] Patent Number: 4,809,856

[45] Date of Patent: Mar. 7, 1989

[54] SHELF DIVIDER

[75] Inventor: James C. Muth, Eagle, Wis.

[73] Assignee: Spacesaver Corporation, Fort Atkinson, Wis.

[21] Appl. No.: 210,330

[22] Filed: Jun. 23, 1988

[51] Int. Cl.[4] ..... A47F 5/00

[52] U.S. Cl. ..... 211/184; 108/60

[58] Field of Search ..... 211/184, 43, 11; 108/60, 61

[56] References Cited

U.S. PATENT DOCUMENTS

| | | | |
|---|---|---|---|
| 3,559,815 | 2/1971 | Huddleston | 211/184 |
| 3,698,568 | 10/1972 | Armstrong | 211/184 |
| 3,868,021 | 2/1975 | Heinrich | 211/184 |
| 4,673,091 | 6/1987 | Robinson | 211/184 |
| 4,712,694 | 12/1987 | Breslow | 211/184 |
| 4,735,324 | 4/1988 | Wilcek | 211/184 |

*Primary Examiner*—Reinaldo P. Machado

*Assistant Examiner*—Sarah A. Lechok Eley

*Attorney, Agent, or Firm*—Fuller, Puerner & Hohenfeldt

[57] ABSTRACT

A sliding shelf divider comprises a generally U-shaped channel and a divider slidable along the channel. The channel has steps at the intersections of the side and bottom walls. The divider comprises a base member having a plate portion with a tab depending therefrom. The base member also has an upstanding ridge with a portion that overhangs the plate portion bottom edge. The tab and overhanging ridge portion form a slot for receiving a channel wall. The tab free end contacts the interior surface of the channel step for supporting the base member, and the free end of the overhanging ridge has a hook that engages the step exterior surface. The base member is thus retained on and slidable along the channel. A wire frame is received within a groove in the ridge. Tilting the base member disengages the hook from the channel for easy disassembly of the base member from the channel.

10 Claims, 1 Drawing Sheet

SHELF DIVIDER

BACKGROUND OF THE INVENTION

1. Field of the Invention

This invention pertains to document management, and more particularly to apparatus for controlling the placement of stored files.

2. Description of the Prior Art

Various equipment has been developed to organize and file documents. A popular design includes horizontal shelves together with horizontally spaced and vertically oriented dividers. The shelves provide vertical support for the documents, and the dividers separate the documents and maintain them in a vertical attitude. In some systems, the dividers are slidable along the shelves to thereby suit changing storage requirements.

A typical prior sliding file support is disclosed in U.S. Pat. No. 4,673,091, wherein a slider, to which is mounted a wire-like file support, is hooked to and slides along a U-shaped channel. The file support of the U.S. Pat. No. 4,673,091 patent is somewhat awkward to remove the channel. Other known file supports also possess various shortcomings.

Thus, a need exists for an improved sliding document holder.

SUMMARY OF THE INVENTION

In accordance with the present invention, an inexpensive sliding shelf divider is provided that is easily positionable along and removable from a horizontal shelf. This is accomplished by apparatus that includes a base member that snugly but releasably slides along a support member.

The base member is preferably comprised of a generally flat plate having a front face. A grooved ridge is joined to and upstands from the plate front face. The ridge may be considerably narrower than the plate. The grooved ridge overhangs the bottom edge of the plate. The free end of the overhanging ridge is formed with a backwardly facing hook. Also extending from the plate bottom edge and parallel to the overhanging ridge is a flexible tab. The tab is offset backwardly across the thickness of the plate from the overhanging ridge, such that the tab and overhanging ridge form a slot therebetween. The tab free end is adjacent the hook on the free end of the overhanging ridge. The tab is preferably as wide as the plate. However, a notch may be cut out in the tab approximately in line with the overhanging ridge, thereby creating two tabs that straddle the overhanging ridge.

The support member of the sliding shelf divider is preferably an elongated generally U-shaped channel having parallel side walls and a bottom wall. The channel is formed with a short step in the side walls near their respective intersections with the bottom wall. The channel is normally placed on a horizontal shelf, with the channel side walls projecting upwardly.

The base member is placed over a channel side wall such that the side wall is received within the slot between the base member tabs and overhanging ridge. The base member tab, the overhanging ridge, and the channel side walls are dimensioned such that when the base member is assembled to the channel, the tab free end rests on a channel step inferior surface, the base member hook on the overhanging ridge engages the exterior surface of the channel step, and a clearance exists between the free end of the channel wall and the bottom edge of the base member plate, and the base member fits snugly on the channel wall. Accordingly, the overhanging ridge hook retains the base member on the channel, but the base member is slidable longitudinally along the channel.

The ridge groove is designed to hold the ends of a document positioning frame, which may be made of an appropriately bent wire rod. When inserted in the ridge groove, the document frame is generally perpendicular to the plane of the base member plate. With the base member in place on the channel, the frame is in a vertical orientation, wherein it can function to contact and control vertical documents filed on the horizontal shelf adjacent the channel.

To remove the base member from the channel, it is necessary merely to tilt the base member such that the overhanging ridge hook is pivoted away from the channel stepped surface. The base member is then simply pulled straight off the channel wall.

Other objects and advantages of the invention will become apparent to those skilled in the art upon reading the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
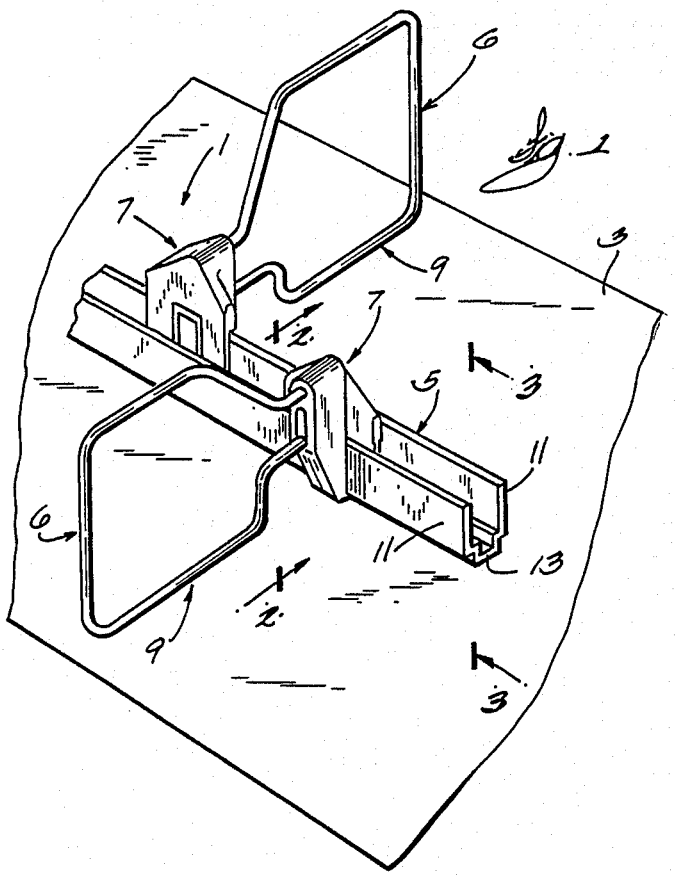
FIG. 1 is a perspective view of a sliding shelf divider according to the present invention.

Referring to FIG. 1, a sliding shelf divider 1 is illustrated that includes the present invention. The sliding shelf divider is particularly useful in conjunction with horizontal shelves 3 for separating and restraining vertical stored files (not shown). However, it will be understood that the invention is not limited to document storage applications.

Figure 4:
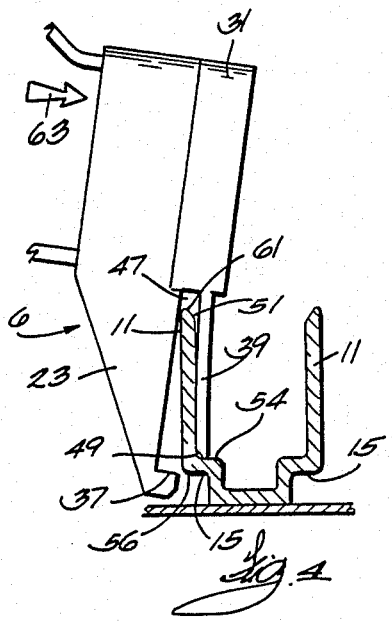
FIG. 4 is a view similar to FIG. 3, but showing the divider in a tilted position for removal from the support member.
Figure 3:
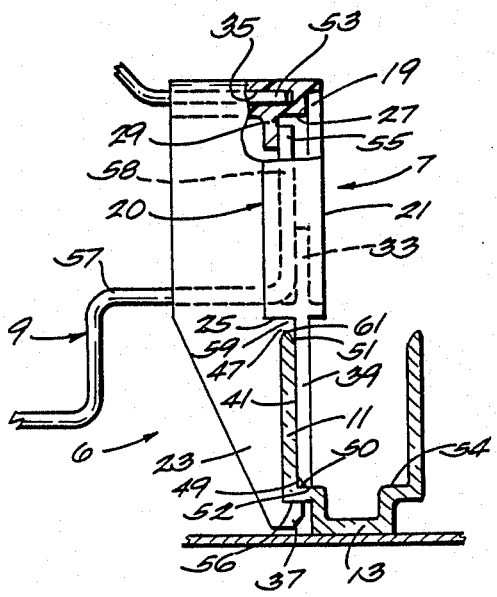
FIG. 3 is an enlarged partially broken view taken along lines 3—3 of FIG. 1.

The sliding shelf divider 1 includes an elongated support member 5 and at least one divider 6. Each divider 6 comprises a base member 7 and a frame 9. The support member 5 is preferably formed as a generally U-shaped channel having laterally spaced side walls 11 upstanding from a bottom wall 13. Also see FIGS. 3 and 4. At the junction of the two side walls 11 and the bottom wall 13, the channel has respective steps 15. The channel is fastened to the shelf 3 at any desired location thereon and by any suitable means.

Figure 2:
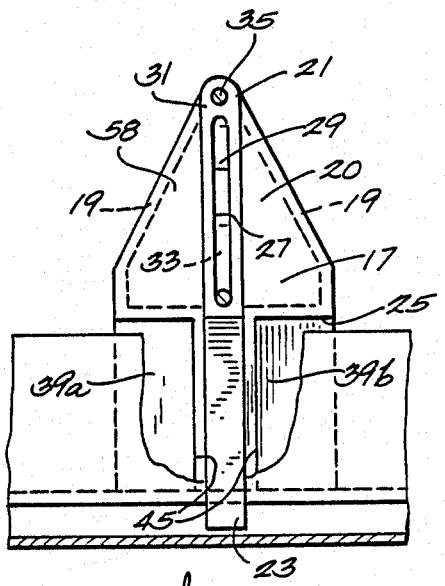
FIG. 2 is an enlarged partially broken view taken along lines 2—2 of FIG. 1.

Slidingly received on the channel 5 are the dividers 6. In the illustrated construction, the divider base member 7 is fabricated with a plate portion 17 bounded by stiffening ribs 19, as is best shown in FIG. 2. Projecting from the front face 20 of the plate portion 17 is a ridge 21. The ridge 21 has a groove 27 that extends through the ridge and the plate. Referring again to FIGS. 3 and 4, a top panel 29 extends between the lateral sides of the groove 27 and blocks a portion of the ridge groove near the base member upper end 31. A lower panel 33, offset backwardly from the top panel 29, blocks a portion of the groove 27 near the plate bottom edge 25. A hole 35 is formed in the ridge near the upper end thereof. The ridge has a portion 23 that overhangs the bottom edge 25 of the base. The lower or free end of the ridge overhanging portion 23 is formed with a backwardly facing hook 37.

The base member 7 further comprises a tab 39 that is joined to and extends from the plate bottom edge 25. If, desired, the tab 39 may be cut out behind the ridge overhanging portion 23, as along lines 45 in FIG. 2, to thereby form two tabs 39*a* and 39*b*. The tab has a front surface 41 that is spaced a predetermined distance from the back surface 43 of the overhanging ridge portion 23. The tab front surface 41 and the overhanging ridge portion back surface 43 define a slot 47. The width of the slot 47 is equal to or slightly less than the thickness of the wall 11 of the channel 5. The base member 7 is assembled to the channel by pushing the base member slot over the channel wall 11. To facilitate assembly, the free ends of the tab 39 and channel wall 11 are formed with chamfers 49 and 51, respectively. The channel and base member are dimensioned such that when the tab lower edge 52 contacts the interior surface 54 of the channel step 15, the hook 37 engages the exterior surface 56 of the channel step. Thus, the tab and hook cooperate to retain the base member on the channel wall. The chamfer 49 serves to provide clearance between the tab and the inner radius 50 of the channel step 15 at the junction of the side wall and the horizontal interior surface 54. The snug fit of the channel wall between the tab 39 and the overhanging ridge portion 23 prevents the divider from moving laterally on the channel wall until a force is applied to do so. With the base member assembled to the channel, a clearance 59 exists between the upper end 61 of the channel wall and the bottom edge 25 of the base member plate portion 17. Thus, the tab free end 52 serves as the vertical support for the divider 6 on the channel.

The frame 9 is preferably fabricated as a single piece of wire bent into a planar configuration. A first end 53 of the frame is inserted into the base member hole 35. The frame second end 55 has an upright leg 58 that fits in the ridge groove 27 between the panels 29 and 33. A second leg 57 of the frame is located adjacent the groove lower end and projects out the front of the ridge.

With the divider 6 in place on a channel wall 11, the divider will move when a force is applied to the base member 7 to slide the divider longitudinally on the channel 5 to the desired location along the shelf 3. As shown in FIG. 1, one or more dividers can be assembled to both channel walls 11, with the respective frames 9 facing oppositely.

To disassemble a divider 6 from the channel 5, a simple two-step procedure is sufficient. The base member 7 is pushed backward, i.e., in the direction of arrow 63 in FIG. 4, near thebase member top end 31. Such tipping causes the hook 37 at the free end of the ridge overhanging portion 23 to disengage from the channel step exterior surface 56. The relatively limber tabs 39*a* and 39*b* bend to permit the plate portion 17 and ridge to tilt and the hook to disengage. With the base member in the position of FIG. 4, it is adequate to merely pull it vertically upwardly with respect to FIG. 4 for simple removal of the base member slot 47 from over the channel wall 11.

Thus, it is apparent that there has been provided, in accordance with the invention, a sliding shelf divider that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A sliding shelf divider comprising:

a. a channel member having at least one upstanding wall and interior and exterior step surfaces; and b. a divider adapted to be assembled to the channel member comprising:

i. a plate portion having a front face, a bottom edge, and an upper edge;

ii. a ridge joined to and upstanding from the plate portion front face and overhanging the plate portion bottom edge, the ridge defining a groove therein, the ridge overhanging portion having a free end that defines a hook adapted to releasably engage the exterior step surface of the channel member; and iii. tab means depending from the plate portion bottom edge for cooperating with the overhanging portion of the ridge to define a slot therebetween sized to accept the upstanding wall of the channel member, so that the tab and overhanging ridge hook cooperate to releasably retain the divider on the channel member and the divider is slidable along the channel member when the divider is assembled thereto.

2. The sliding shelf divider of claim 1 wherein:

a. the tab means comprises at least one flexible tab extending from the bottom edge of the divider plate portion and having a free end that is in contact with the interior step surface of the channel member when the divider is assembled thereto; and b. the flexible tab has a length such that a clearance is present between the free end of the channel wall and the bottom edge of the plate portion when the divider is assembled to the channel member.

3. The sliding shelf divider of claim 1 wherein:

a. the groove in the ridge extends through the base member plate portion; and b. the base member further comprises:

i. a first panel extending across the ridge groove to block a portion of the groove through the ridge and plate portion near the upper end thereof; and ii. a second panel extending across the ridge groove to block a portion of the groove through the ridge and plate portion near the bottom edge thereof, the second panel being offset backwardly from the first panel.

4. The sliding shelf divider of claim 3 wherein the divider further comprises a frame adapted to be received within the ridge groove, the frame having a free end with a first leg that interfits in the offset between the first and second panels and a second leg that extends outwardly from the ridge groove near the bottom edge of the plate portion.

5. The sliding shelf divider of claim 2 wherein the tab means comprises two flexible tabs that straddle the overhanging ridge.

6. An article for being removably assembled to a planar member for sliding therealong comprising:

a. a plate portion having a front face, a top end, and a bottom edge;

b. a ridge having a free end formed integrally with the plate portion and upstanding from the front face thereof and overhanging the plate portion bottom edge, the free end of the overhanging ridge defining a hook facing away from the plate portion front face and adapted to engage the planar member to assist releasably assembling the article thereto, the ridge defining a groove therein; and c. at least one flexible tab depending from the plate portion bottom edge and being offset from the overhanging ridge to cooperate therewith to define a slot having a width sized to receive the planar member therein, the tab having a free end for supporting the article on the planar member, the tab free end being located proximate the overhanging ridge hook.

d. a first panel extending transversely across the ridge groove and blocking a portion of the groove near the plate portion upper end; and e. a second panel extending transversely across the ridge groove and offset from the first panel and blocking a portion of the groove near the plate portion bottom edge.

7. The article of claim 6 wherein there are two flexible tabs depending from the plate portion bottom edge and straddling the overhanging ridge.

8. A sliding shelf divider comprising:

a. a horizontal shelf for holding selected items;

b. at least one channel member fastened to the shelf, the channel member having a pair of upstanding walls having respective free ends, a bottom wall, and steps formed at the intersections of the respective upstanding walls with the bottom wall, the steps having respective interior and exterior surfaces;

c. a base member comprising:

i. a plate portion having a front face, a top end, and a bottom edge;

ii. at least one flexible tab depending from the plate portion bottom edge and having a free end for contacting the interior surface of a selected channel member step, there being a clearance between the channel member wall free end and the plate portion bottom edge; and iii. a ridge formed integrally with the plate portion and upstanding from the front face thereof and having a groove therein, the ridge having a portion that overhangs the plate portion bottom edge, the free edge of the overhanging ridge portion being formed with a hook for engaging the exterior surface of the channel member step when the tab free end contacts the channel member step interior surface to thereby releasably assemble the base member to the channel member; and d. frame means retained in the base member ridge groove for controlling selected items placed on the shelf, so that the base member is assembleable to the channel member and slidable to selective locations there along to control the items placed on the shelf.

9. The sliding shelf divider of claim 8 wherein there are two flexible tabs depending from the plate portion bottom edge, the tabs straddling the overhanging ridge portion.

10. The sliding shelf divider of claim 8 wherein:

a. the base member further comprises:

i. a first panel extending across the ridge groove to block a portion thereof near the plate portion upper end; and ii. a second panel extending across the ridge groove and offset from the first panel to block a portion of the groove near the plate portion bottom edge; and b. the frame means comprises a bent wire rod having a first end that is received in the base member ridge groove between the first and second panels.

* * * * *